United States Patent [19]

Crance

[11] 4,098,027

[45] Jul. 4, 1978

[54] SLIDING-DOOR AND SLIDING-SCREEN SILL

[76] Inventor: James M. Crance, 1776 Newport Blvd., Costa Mesa, Calif. 92627

[21] Appl. No.: 866,534

[22] Filed: Jan. 3, 1978

[51] Int. Cl.[2] ..... E06B 1/04

[52] U.S. Cl. ..... 49/504; 16/96R; 49/468; 49/425; 160/90; 52/98

[58] Field of Search ..... 49/504, 505, 425, 420, 49/467, 468, 471; 16/96 R, ; 160/90, 91; 52/98, 100

[56] References Cited

U.S. PATENT DOCUMENTS

| | | | |
|---|---|---|---|
| 3,136,396 | 6/1964 | Sullivan | 160/91 X |
| 3,248,822 | 5/1966 | Sincock | 49/425 |
| 3,422,584 | 1/1969 | Howard | 52/98 |
| 3,854,245 | 12/1974 | Anderson | 49/504 X |
| 3,855,732 | 12/1974 | Sheaf | 49/425 |

FOREIGN PATENT DOCUMENTS

| | | | |
|---|---|---|---|
| 283,789 | 6/1966 | Australia | 49/425 |

*Primary Examiner*—Philip C. Kannan
*Attorney, Agent, or Firm*—Harvey C. Nienow

[57] ABSTRACT

A sliding-door and sliding-screen sill having several elongated rail members for individually supporting a sliding-door and a sliding-screen. Each such rail member is extruded of aluminum and is formed with at least one elongated break-notch whereby an installer can remove substantially any desired width of the base of either or both rail members to enable them to be placed in juxtaposition and yet cause the rails to be spaced the desired distance as defined by thee relationship between the exisiting sliding-door and sliding-screen. An L-shaped foundation member and a spacer are employed, the rail members being secured to one side of the foundation member.

7 Claims, 8 Drawing Figures

SLIDING-DOOR AND SLIDING-SCREEN SILL

The present invention relates generally to sliding-door and sliding-screen sills, but more particularly to elements for rebuilding door sills for existing sliding-door/sliding-screen combinations.

Within recent years, particularly in the more temperate climates, relatively large sliding-doors and screens have been utilized for doorways of residential buildings. In such areas, a greater emphasis is placed on activities out of doors, and therefore patio doors having large glass and screen panels are particularly popular.

Typically, such sliding-door and sliding-screen structures are framed with aluminum extrusions which define the door jambs as well as the door sill including the rails whereon the doors are caused to slide or roll. However, after considerable exposure of such aluminum extrusions to salt air and varying temperatures, the door sills become inoperable and hence must be replaced. Heretofore, it has been necessary to replace the entire door, screen and the entire door frame including the sill — a considerable expense merely because of the loss of the sill itself.

Such replacement of the entire door structure has been necessary because the particular extrusions which define the separation between adjacent door rails as well as their location relative to the wood underframe are no longer available. Each manufacturer designs his own extrusions, and if such manufacturer is no longer in business, the proper extrusions are no longer available.

The present invention has as one of its principal objects, the provision of extrusions whereby an installer can, in the field, rebuild a sliding-door/sliding-screen sill in accordance with the existing positions of the sliding door and screen.

Another object of the present invention is to provide a sliding-door/sliding-screen sill as characterized above which can be properly built and installed in the field without the need for any special or unusual tools or any special skills.

A still further object of the present invention is to provide a sliding-door/sliding-screen sill as characterized above which is formed almost exclusively of extruded aluminum parts which can be easily and quickly made to conform to existing dimensions in the field.

An even further object of the present invention is to provide a sliding-door/sliding-screen sill as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawings.

Figure 1:
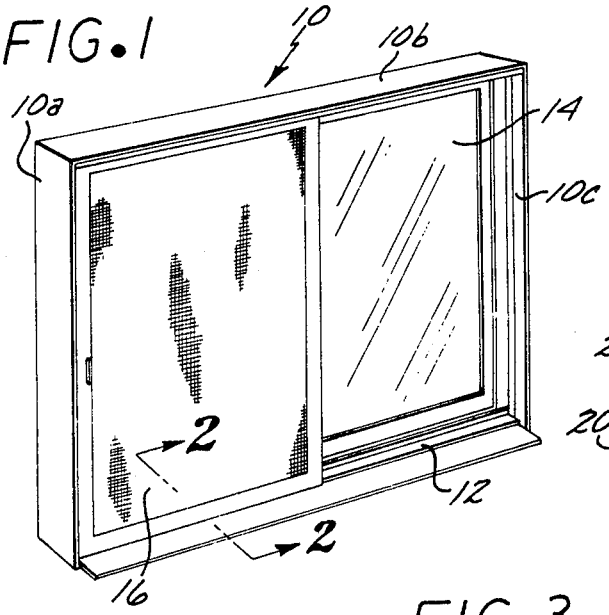
FIG. 1 is a perspective view of a sliding-door/sliding-screen combination according to the present invention.

Referring to FIG. 1 of the drawings, there is shown therein a sliding-door/sliding-screen assembly 10 which includes door frame members **10*a*, 10*b* and 10*c* as well as a sill 12. In addition thereto, the assembly 10 includes a stationary glass panel 14, a movable screen 16 and a movable glass panel 18, a portion of which is shown most particularly in FIG. 2 of the drawings. Typically, the stationary panel 14 is firmly mounted in the frame and on sill 12. The screen panel 16 and glass panel 18**, on the other hand, are slideable on rails between open and closed positions.

Figure 2:
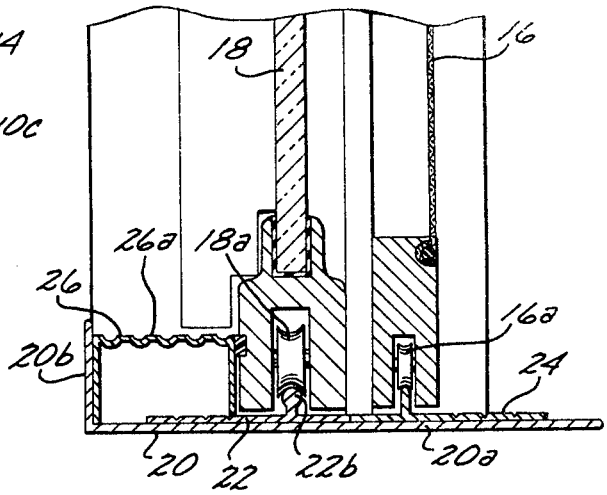
FIG. 2 is a fragmentary sectional view taken substantially along line 2—2 of FIG. 1.

Most typically, the sill of such sliding-door and sliding-screen assembly 10 will deteriorate requiring replacement as shown most particularly in FIG. 2 of the drawings.

Figure 3:
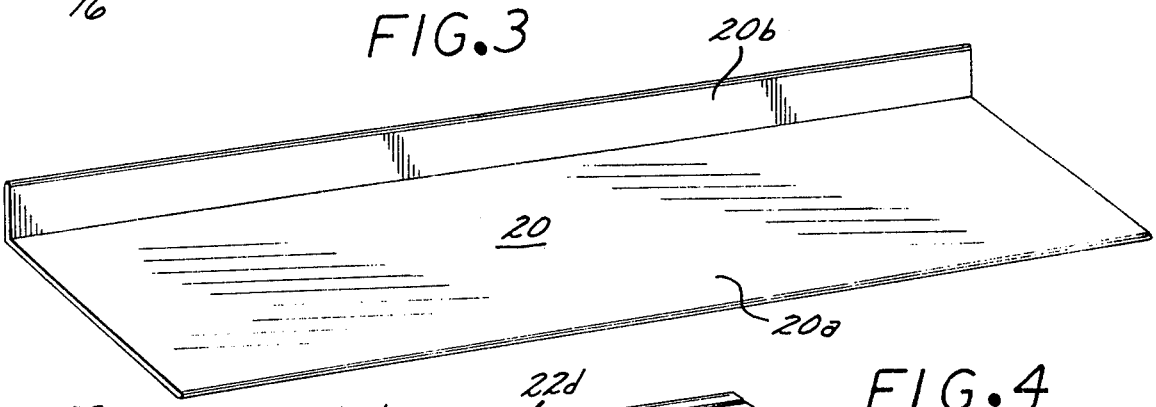
FIG. 3 is a perspective view of a foundation member used in the subject door and screen sill.

Shown in FIG. 3 of the drawings is an L-shaped foundation member 20 which is made of aluminum by the extrusion process and thus can be cut to substantially any desired length. Such foundation member is L-shaped having a long side **20*a* and a short side 20*b***.

Figure 4:
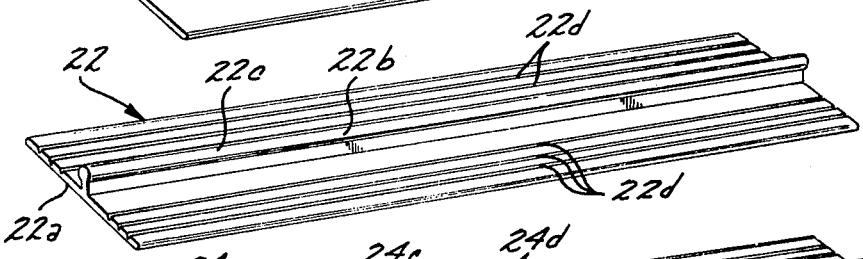
FIG. 4 is a further rail member for use therein.

Shown in FIG. 4 is a first rail member 22 having a base **22*a* and an upstanding rail 22*b*. This member is also formed of aluminum by the extrusion process and hence can be cut to substantially any length. The rail 22*b* is substantially centrally located on base 22*a* and extends the entire length thereof. As shown in FIG. 4, rail 22*b* is formed with a generally arcuate or semi-circular top surface 22*c* to accommodate the roller of a sliding-door as shown in FIG. 2** of the drawings, and as will hereinafter be more fully explained.

On either side of rail **22*b* and formed in or on base 22*a* is a plurality of break-notches 22*d* which extend the entire length of the member 22** and which are generally V-shaped such as to afford a continuous indentation as shown.

Figure 5:
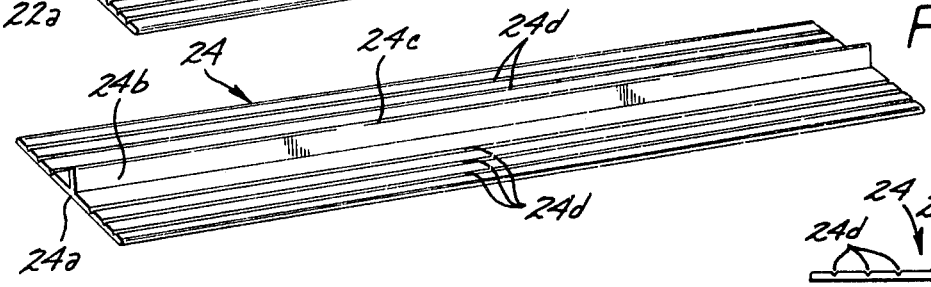
FIG. 5 is a second rail member for use in the subject door/screen sill.

In FIG. 5 of the drawings is a second rail member 24 which is formed of aluminum by the extrusion process, and comprises a base **24*a* and a rail 24*b*. Such rail is also formed with a generally curved or arcuate top edge 24*c*, and break-notches 24*d* are formed in the base 24*a*** as shown.

A spacer of substantially any desired design is also utilized, and is preferably formed of aluminum by the extrusion process. One such design is shown at 26 in FIGS. 2, 7 and 8 of the drawings, such spacer being generally U-shaped and provided with a plurality of ribs as shown at **26*a***.

Figure 6:
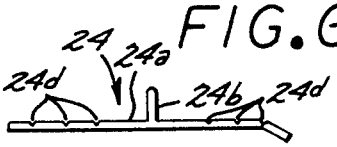
FIG. 6 is an end view of the rail member of FIG. 5 showing a portion being broken away.

As shown in FIG. 2 of the drawings, after the deteriorated door/screen sill has been removed, the position of the foundation member 20 can be determined with respect to the width of the door frame and things adjacent thereto such as carpeting, flooring and the like. Thereafter, the position of the sliding glass door 18 can be determined so as to thereby define the position of the rail member 22 on the foundation member 20. At the same time, the position of the second rail member 24 can be determined as defined by the position of the sliding-door/screen 16 relative to the foundation member. Since the members 22 and 24, for proper appearance and operation, should be juxtaposed on the upper surface of side 20*a* of foundation member 20, it will be necessary to adjust the width of one or the other or both of members 22 and 24. This is easily accomplished by the use of pliers or vice grips to break away a portion of the length of either or both of such members 22 and 24. This procedure is shown in FIG. 6 wherein the extrusion 24 is being broken away along one of the break-notches 24*d*.

By suitable adjustment of the widths of members 22 and 24 the rails 22*b* and 24*b* can be properly spaced and properly positioned on the foundation member 20, without a gap appearing between the bases 22*a* and 24*a* and without any overlapping. In this regard, it is contemplated that the distance between the parallel break-notches on the members 22 and 24 can vary so that different combinations can be provided to define different spacing distances between the rails 22*b* and 24*b*.

It is also contemplated that the outer edges of the members 22 and 24 which are parallel with the respective rails might be beveled so as to cooperate with the edge which results from the aforedescribed breaking away of a portion of the base member so as to provide a pleasing appearing V-shape indentation. This is consistent with and similar to the remaining break-notches which would not have been used to vary the width of the respective rail member.

With the members 22 and 24 firmly secured to the foundation member 20 as by riveting, screwing, gluing or the like, the entire assembly provides a sill, including a threshold for the sliding-screen 16 and sliding-door 18. Several rollers mounted on door 18, one of which is shown at 18*a* in FIG. 2, are covered to roll on the arcuate upper surface of rail 22*b*. In like fasion several rollers on the screen-door 16, one being shown at 16*a*, are caused to roll on rail 24*b*. The U-shaped spacer 26 can be positioned between the door 18 and the short side 20*b* in inverted position, to match the level of the interior of the house or other building.

Figure 7:
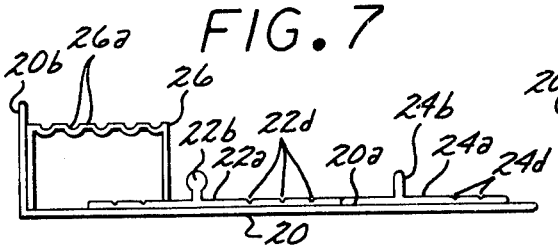
FIG. 7 is an end elevational view showing one possible arrangement of parts.
Figure 8:
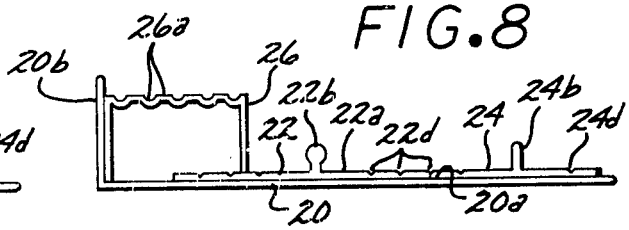
FIG. 8 is an end elevational view showing another possible arrangement of parts.

FIGS. 7 and 8 show various different combinations of variation in the width of the bases of the rail members 22 and 24.

It is thus seen that the present invention provides a sliding-door/sliding-screen sill which can be adapted to substantially any existing sliding-door and sliding-screen. Although I have shown and described certain specific embodiments of my invention, I am well aware that many modifications thereof are possible. The invention itself is not to be restricted except insofar as is necessitated by the prior art and by the spirit of the appended claims.

I claim:

1. A sliding-door and sliding-screen sill comprising in combination, first and second rail members each having a base and an elongated rail thereon and being formed with at least one elongated break-notch in said base to vary as desired the width of said base, said rail members being positionable in juxtaposed relation with any one of several dimensions between said rails by breaking away a portion of the base of either or both of said rail members to accommodate existing spacing between a sliding door and sliding screen.

2. The invention according to claim 1, wherein said bases of said first and second rail members are individually formed of aluminum and said break-notches are generally V-shaped therein.

3. The invention according to claim 2, wherein each of said rail members is extruded and each break-notch extends the length of the base.

4. The invention according to claim 3, wherein said elongated rails of each of said rail members is formed with an arcuate surface to accommodate a pair of rollers on the corresponding one of said door and screen.

5. The invention according to claim 4, wherein a spacer is included to be positioned adjacent the rail member for said sliding-door.

6. The invention according to claim 5, wherein said spacer is generally U-shaped and is inverted when positioned adjacent said sliding-door rail member.

7. The invention according to claim 6, wherein an L-shaped foundation member is included having a long side to which said first and second rail members are secured, said spacer being positioned between said sliding-door rail member and the short side of said foundation member.

* * * * *